US010373555B2

(12) United States Patent
Li et al.

(10) Patent No.: US 10,373,555 B2
(45) Date of Patent: Aug. 6, 2019

(54) ORGANIC LIGHT EMITTING DISPLAY PANEL, ORGANIC LIGHT EMITTING DISPLAY DEVICE, AND PIXEL COMPENSATION METHOD

(71) Applicant: SHANGHAI TIANMA AM-OLED CO., LTD., Shanghai (CN)

(72) Inventors: Yue Li, Shanghai (CN); Gang Liu, Shanghai (CN); Dongxu Xiang, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 0 days.

(21) Appl. No.: 15/596,390

(22) Filed: May 16, 2017

(65) Prior Publication Data

US 2017/0249904 A1 Aug. 31, 2017

(30) Foreign Application Priority Data

Jan. 5, 2017 (CN) ..... 2017 1 0006639

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2300/0861* (2013.01); *G09G 2310/08* (2013.01); *G09G 2320/0233* (2013.01); *G09G 2320/045* (2013.01)

(58) Field of Classification Search
None
See application file for complete search history.

(56) References Cited

U.S. PATENT DOCUMENTS

2011/0122119 A1* 5/2011 Bae ..... G09G 3/3233 345/211
2016/0155380 A1* 6/2016 Kwon ..... G09G 3/3233 345/78
2016/0189661 A1* 6/2016 Kim ..... G09G 3/3283 345/211
2017/0206836 A1* 7/2017 Kim ..... G09G 3/3233
2017/0249882 A1* 8/2017 Lee ..... G09G 3/006

FOREIGN PATENT DOCUMENTS

CN 103123774 A 5/2013

OTHER PUBLICATIONS

Chinese, 1st Office Action dated Jun. 15, 2018.

* cited by examiner

*Primary Examiner* — Andre L Matthews
(74) *Attorney, Agent, or Firm* — Alston & Bird LLP

(57) ABSTRACT

The present application discloses an organic light emitting display panel, an organic light emitting display device, and a pixel compensation method. The panel comprises data line sets; a pixel array; pixel driving circuits; and a pixel compensation circuit, configured to provide a bias current, sample an anode voltage of an organic light emitting diode, and generate a compensated data voltage based on the bias current and the anode voltage. A power module is configured to provide the bias current to the data line set, and transmit the bias current via the data line set to the organic light emitting diode. A sampling module samples the anode voltage of the organic light emitting diode via the data line set. A data voltage generation module transmits the compensated data voltage via the data line set to the pixel driving circuit based on the anode voltage and the bias current.

11 Claims, 11 Drawing Sheets

ORGANIC LIGHT EMITTING DISPLAY PANEL, ORGANIC LIGHT EMITTING DISPLAY DEVICE, AND PIXEL COMPENSATION METHOD

CROSS-REFERENCE TO RELATED APPLICATION

This application is related to and claims priority from Chinese Patent Application No. CN201710006639.4, filed on Jan. 5, 2017, entitled "Organic Light Emitting Display Panel, Organic Light Emitting Display Device, and Pixel Compensation Method," the entire disclosure of which is hereby incorporated by reference for all purposes.

TECHNICAL FIELD

The present application relates to the field of display technologies, and particularly to an organic light emitting display panel, an organic light emitting display device, and a pixel compensation method.

BACKGROUND

Organic light-emitting diodes (OLEDs) are thin-film light-emitting devices made of organic semiconductor materials and driven by a DC voltage. OLEDs are made with very thin organic coatings and glass substrates, and require no backlight. When a current flows through, the organic materials emit light.

In general, the brightness of the individual pixels is different due to various reasons, for example, difference in electrical characteristics of each driving transistor, variation of the high potential driving voltage at different display locations, and degradation of the OLEDs. Accordingly, the brightness of the OLED display is non-uniform. When this difference intensifies, image remnant trace appears and the image quality is deteriorated.

In order to improve the display result of an OLED display, pixel compensation is generally provided on the OLEDs. The pixel compensation methods may include internal compensation and external compensation. The internal compensation refers to a compensation method using a bootstrap circuit constructed with a thin film transistor inside a pixel. The external compensation refers to a method whereby the electrical or optical characteristics of the pixel driving circuit are sensed by an external driving circuit or a device, and then compensated. In the existing methods for compensating the OLED in the pixel driving circuit, although the compensation of the OLED is accomplished, the brightness of the OLED cannot be guaranteed to be constant, so that the display result of the organic light emitting display panel after the compensation is still less than ideal.

SUMMARY

The present application discloses an organic light emitting display panel, an organic light emitting display device, and a pixel compensation method, so as to solve the technical problems mentioned in the background.

In a first aspect, the present application provides an organic light emitting display panel. The organic light emitting display panel includes a plurality of data line sets, each of the data line sets comprising at least one data line; a pixel array, comprising pixel regions having M rows and N columns, M and N being positive integers; a plurality of pixel driving circuits, the pixel driving circuits being electrically connected to the data line sets, each of the pixel driving circuits comprising an organic light emitting diode and corresponding to a respective pixel region of the pixel regions; and a pixel compensation circuit, configured to provide a bias current to at least one of the pixel driving circuits, sample an anode voltage of the organic light emitting diode, and generate a compensated data voltage based on the bias current and the anode voltage. The pixel compensation circuit includes a power module, a sampling module, and a data voltage generation module. Each of the data line is electrically connected, via a switch element, to the power module, the sampling module, and the data voltage generation module. The power module is configured to provide the bias current signal to the data line set, and transmit the bias current signal, via the data line set, to an anode of the organic light emitting diode. The sampling module samples the anode voltage of the organic light emitting diode via the data line set. The data voltage generation module transmits the compensated data voltage, via the data line set, to the pixel driving circuit based on the anode voltage and the bias current.

In a second aspect, the present application provides a pixel compensation method for the above organic light emitting display panel. The pixel compensation method includes: in a precharge phase, the power module transmitting a bias current signal to the data line set, and a first threshold compensation unit transmitting the bias current signal to the anode of the organic light emitting diode on the basis of the data line set, so as to precharge the data line set and the organic light emitting diode; in a threshold detection phase, the first threshold compensation unit transmitting an anode voltage of the organic light emitting diode to the data line set based on a signal from a data detection signal line, and the sampling module obtaining the anode voltage via the data line set; repeating the precharge phase and the threshold detection phase, to determine a current-voltage-brightness curve of the organic light emitting diode, and degraded voltages corresponding to different working currents; in a data write phase, the data voltage generation module transmitting a data voltage to the data line set, a first data write unit transmitting the data voltage and a first source voltage to a first storage unit based on a signal from the scan line, and the pixel driving circuit completing the writing of data; and in a light emission phase, a first reset unit and a first light emission control unit being turned on based on a signal from a light emission control signal line, a first driving transistor providing a drive current to the organic light emitting diode, and the organic light emitting diode emitting light.

In a third aspect, the present application provides a pixel compensation method for the above organic light emitting display panel. The pixel compensation method comprises: in a reset phase, the power module transmitting a third source voltage to the data line, and a second data write unit transmitting the third source voltage to a gate of a second driving transistor based on a signal from a scan line, to accomplish the resetting of the second driving transistor; in a threshold detection phase, the power module transmitting a current signal and a voltage signal to the data line in a time division mode, the sampling module sampling a bias voltage of the organic light emitting diode and a threshold voltage of the second driving transistor, and the data voltage generation module generating a data voltage according to the bias voltage and the threshold voltage; in a data write phase, the data voltage generation module transmitting the data voltage to the data line, and the second data write unit transmitting the data voltage to the gate of the second driving transistor based on a signal from the scan line, to accomplish the writing of data; and in a light emission phase, a second light emission control unit being turned on based on a signal from a light emission control signal line, and the organic light emitting diode emitting light.

In a fourth aspect, the present application provides an organic light emitting display device. The organic light emitting display device includes the organic light emitting display panel described in the above embodiments.

According to the organic light emitting display panel, the organic light emitting display device, and the pixel compensation method arranged in the present application, a power module, a sampling module, and a data voltage generation module is disposed in the pixel compensation circuit. The power module provides a bias current signal to the organic light emitting diode in each of the pixel driving circuits, for detecting the anode voltage of each organic light emitting diode. Considering that after long-term use of the organic light emitting diode, the threshold voltage is shifted and the brightness also changes accordingly, therefore, in this embodiment, the brightness of the organic light emitting diode is ensured to be unchanged when the organic light emitting diode is compensated, thereby improving the precision of compensation on the organic light emitting diode, and improving the display effect of the organic light emitting display panel.

BRIEF DESCRIPTION OF THE DRAWINGS

Other features, objects, and advantages of the present application will become more apparent upon reading of the following detailed description of the non-limiting embodiments with reference to the accompanying drawings, in which.

DETAILED DESCRIPTION OF EMBODIMENTS

The present application will be further described below in detail in combination with the accompanying drawings and the embodiments. It should be appreciated that the specific embodiments described herein are merely used for explaining the relevant invention, rather than limiting the invention. In addition, it should be noted that, for the ease of description, only the parts related to the relevant invention are shown in the accompanying drawings.

It should also be noted that the embodiments in the present application and the features in the embodiments may be combined with each other on a non-conflict basis. The present application will be described below in detail with reference to the accompanying drawings and in combination with the embodiments.

Figure 1:
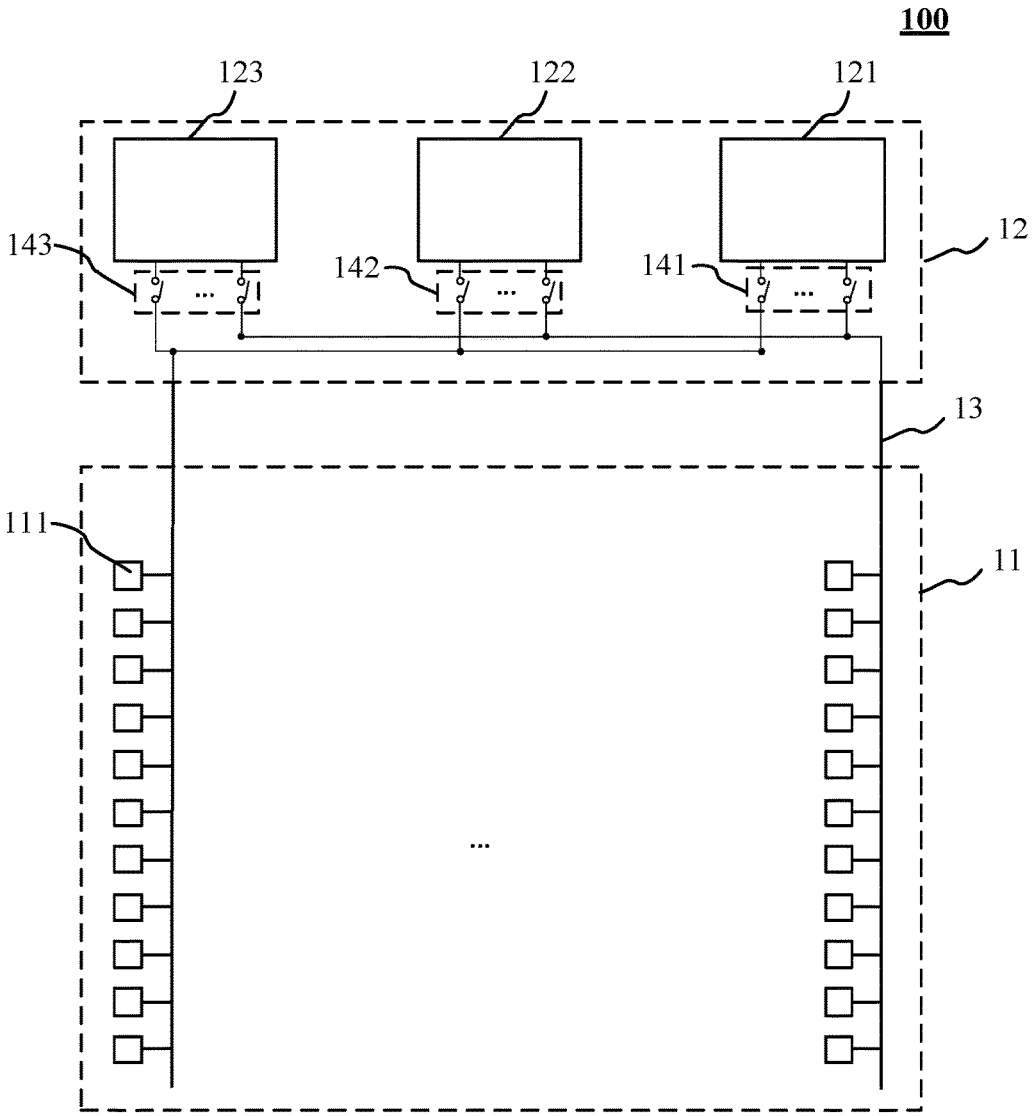
FIG. 1 shows a schematic structural diagram of an embodiment of an organic light emitting display panel according to the present application.

FIG. 1 shows a schematic structural diagram of an embodiment of an organic light emitting display panel according to the present application. As shown in FIG. 1, an organic light emitting display panel 100 in this embodiment includes a pixel array 11, a pixel compensation circuit 12, data line sets 13, and a switch element.

The pixel array includes pixel regions 111 having M rows and N columns, in which M and N are an positive integers. One pixel driving circuit is formed in each of the pixel regions 111, and each of the pixel driving circuits is electrically connected to each of the data line sets 13. The data line set includes at least one data line. In some optional implementations, the data line set 13 includes two data lines.

Each of the pixel driving circuits includes an organic light emitting diode, and the pixel compensation circuit 12 is configured to provide a bias current to the pixel driving circuits, sample an anode voltage of the organic light emitting diode in each of the pixel driving circuits, and then generate a compensated data signal according to the bias current and the anode voltage. External compensation can be made to a degraded voltage of the organic light emitting diode by the external compensation unit according this embodiment.

Specifically, the pixel compensation circuit includes a power module 121, a sampling module 122, and a data voltage generation module 123. Each of the data line sets 13 is electrically connected via the switch elements respectively to the power module 121, the sampling module 122 and the data voltage generation module 123. The switch elements include a first switch array 141, a second switch array 142, and a third switch array 143. Specifically, each of the data line sets 13 is electrically connected via the first switch array 141 to the power module 121; each of the data line sets 13 is electrically connected via the second switch array 142 to the sampling module 122; and each of the data line sets 13 is electrically connected via the third switch array 143 to the data voltage generation module 123. The first switch array 141 includes a plurality of switches that is switched on or off in response to a first switch control signal Ø1; the second switch array 142 includes a plurality of switches that is switched on or off in response to a second switch control signal Ø2; and the third switch array 143 includes a plurality of switches that is switched on or off in response to a third switch control signal Ø3.

The power module 121 is configured to output the bias current signal for detecting the degradation level of the organic light emitting diode. The bias current signal is transmitted via the switches in the first switch array 141 to each of the data line sets 13, and then transmitted via the data line set 13 to the organic light emitting diode in each of the pixel driving circuits. The sampling module 122 communicates, via the switches in the second switch array 142, with the data line sets 13, to sample the anode voltage of the organic light emitting diode. The data voltage generation module 123 generates the compensated data signal according to the bias current signal provided by the power module 121 and the anode voltage sampled by the sampling module 122, communicates via the switches in the third switch array 143 with each of the data line sets 13, and transmits the compensated data signal to each of the pixel driving circuits. In this manner, external compensation on the degraded voltage of the organic light emitting diode is accomplished.

In the organic light emitting display panel provided in the embodiment of the present application, a power module, a sampling module, and a data voltage generation module are arranged in the pixel compensation circuit. The power module provides a bias current signal to the organic light emitting diode in each of the pixel driving circuits, for detecting the anode voltage of each organic light emitting diode. Considering that after long-term use of the organic light emitting diode, the threshold voltage is shifted and the brightness also changes accordingly, therefore, in this embodiment, the brightness of the organic light emitting diode is ensured to be unchanged when the organic light emitting diode is compensated, thereby improving the precision of compensation on the organic light emitting diode, and improving the display effect of the organic light emitting display panel.

In some optional implementations of this embodiment, the pixel driving circuit further includes a driving transistor. The driving transistor is configured to drive the organic light emitting diode. The power module 121 may further provide a threshold voltage detection signal. The threshold voltage detection signal is transmitted via the switch array 141 to the data line sets 13, and the data line set 13 transmits the threshold voltage detection signal to a gate and a drain of the driving transistor. The sampling module 122 communicates via the switch array 142 with the data line sets 13, and obtains, via the data line set 13, a gate voltage and a drain voltage of the driving transistor, to determine a threshold voltage of the driving transistor according to the gate voltage and the drain voltage. In this manner, internal compensation can be further made to the threshold voltage of the driving transistor.

The pixel driving circuit of this implementation can further perform internal compensation on the threshold voltage of the driving transistor, whereby compensation on both the organic light emitting diode and the driving transistor is accomplished, and the display effect of the organic light emitting display panel is further improved.

Figure 2:
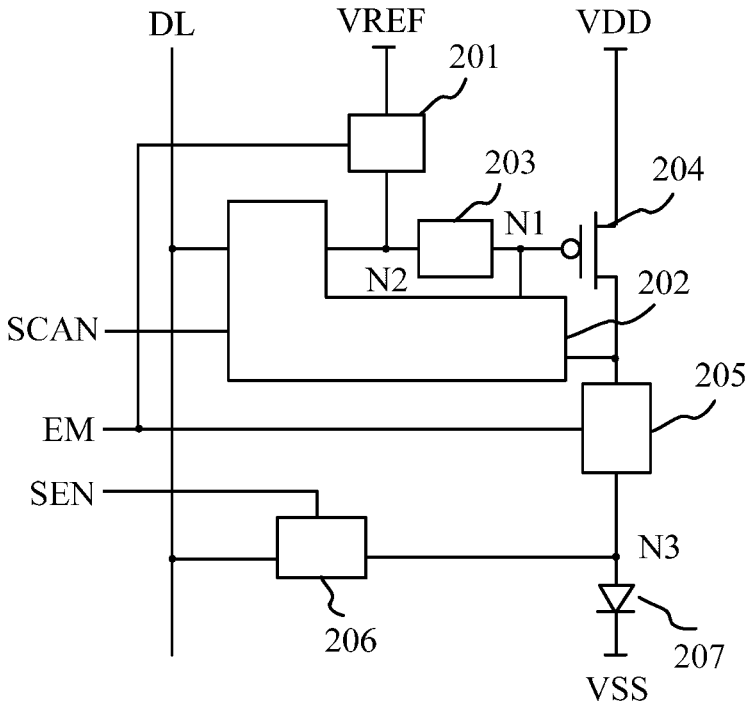
FIG. 2 shows a schematic structural diagram of an embodiment of a pixel driving circuit on an organic light emitting display panel according to the present application.

FIG. 2 shows a schematic structural diagram of an embodiment of a pixel driving circuit on an organic light emitting display panel according to the present application. The organic light emitting display panel in this embodiment further includes a scan line SCAN, a light emission control line EM, a reference signal line VREF, and a threshold detection signal line SEN. The scan line SCAN is configured to provide a scan signal, the light emission control line EM is configured to provide a light emission control signal, the reference signal line VREF is configured to provide a reference signal that is generally a fixed voltage Vref, and the threshold detection signal line SEN is configured to provide a threshold detection signal. The pixel driving circuit in this embodiment includes a first reset unit 201, a first data write unit 202, a first storage unit 203, a first driving transistor 204, a first light emission control unit 205, and a first threshold compensation unit 206.

The first reset unit 201 is electrically connected to the reference signal line VREF, and transmits the reference signal to a second node N2 based on a light emission control signal provided from the light emission control line EM, in which the second node N2 is a connection point of the first reset unit 201, the first data write unit 202, and the first storage unit 203.

The first data write unit 202 is electrically connected to a data line set DL, and transmits a data signal from the data line set DL to the second node N2 and a first node N1 based on a scan signal provided from the scan line SCAN, in which the first node N1 is a connection point of the first data write unit 202, the first storage unit 203, and the first driving transistor 204, and the first node N1 is also a gate of the first driving transistor 204.

The first storage unit 203 is electrically connected respectively to the first data write unit 202 and the first driving transistor 204, in which a connection point to the first data write unit 202 is the second node N2, and a connection point to the first driving transistor 204 is the first node N1. The first storage unit 203 is configured to store a voltage of the first node N1 and the second node N2.

The first light emission control unit 205 is electrically connected to the light emission control signal line EM and to the first driving transistor 204 and an organic light emitting diode 207, and configured to control the light emission of the organic light emitting diode 207 based on a light emission control signal provided from the light emission control signal line EM.

The first threshold compensation unit 206 is electrically connected to the data line set DL, and transmits the signal from the data line set DL to an anode of the organic light emitting diode 207 based on a threshold detection signal provided from the threshold detection signal line SEN, and the first threshold compensation unit 206 can also sample an anode voltage of the organic light emitting diode 207 based on a threshold detection signal provided from the threshold detection signal line SEN, and transmit the sampled anode voltage to the data line set DL.

The anode of the organic light emitting diode 207 is electrically connected respectively to the first threshold compensation unit 206 and the first light emission control unit 205, and a cathode of the organic light emitting diode 207 is electrically connected to a first source voltage terminal VSS. A second electrode of the first driving transistor 204 is electrically connected to a second source voltage terminal VDD.

Figure 2A:
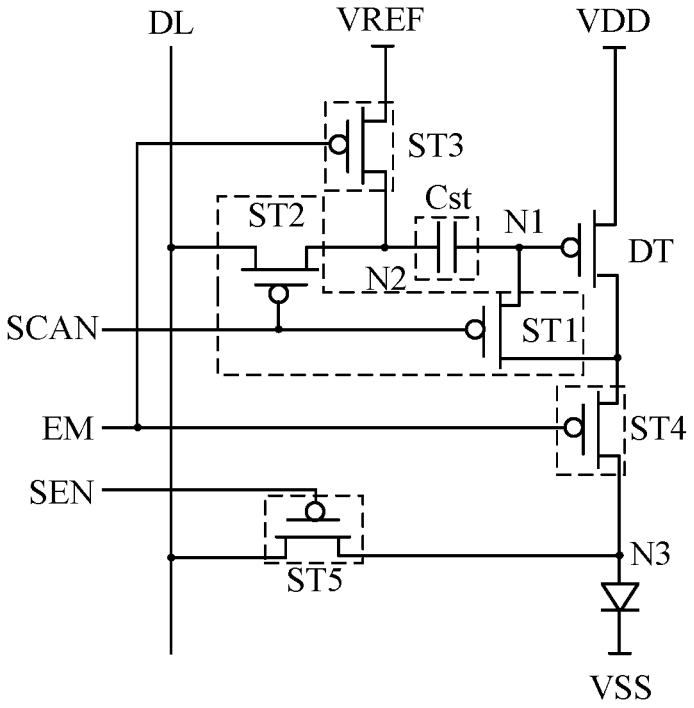
FIG. 2*a* shows a schematic structural diagram of an implementation of a pixel driving circuit on an organic light emitting display panel according to the present application.

In some optional implementations of this embodiment, the data line set DL includes one data line. Specifically, the pixel driving circuit has a structure as shown in FIG. 2*a*. In FIG. 2*a*, the first data write unit 202 includes a first transistor ST1 and a second transistor ST2, the first reset unit 201 includes a third transistor ST3, the first storage unit 203 includes a first storage capacitor Cst, the first light emission control unit 205 includes a fourth transistor ST4, and the first threshold detection unit 206 includes a fifth transistor ST5.

As shown in FIG. 2*a*, a gate of the first transistor ST1 and a gate of the second transistor ST2 are electrically connected to the scan line SCAN, a first electrode of the first transistor ST1 is electrically connected to the gate of the first driving transistor DT, a second electrode of the first transistor ST1 is electrically connected to the second electrode of the first driving transistor DT, a first electrode of the second transistor ST2 is electrically connected to the data line, and a second electrode of the second transistor ST2 is electrically connected respectively to the first reset unit 201 and the first storage unit 203.

A gate of the third transistor ST3 is electrically connected to the light emission control signal line EM, a first electrode of the third transistor ST3 is electrically connected to the reference signal line VREF, a second electrode of the third transistor ST3 is electrically connected respectively to the second electrode of the second transistor ST2 and the first storage unit 203.

A gate of the fourth transistor ST4 is electrically connected to the light emission control signal line EM, a first electrode of the fourth transistor ST4 is electrically connected respectively to the second electrode of the first driving transistor DT and the second electrode of the first transistor ST1, and a second electrode of the fourth transistor ST4 is electrically connected to the anode of the organic light emitting diode.

A gate of the fifth transistor ST5 is electrically connected to the threshold detection signal line, a first electrode of the fifth transistor ST5 is electrically connected to the data line, and a second electrode of the fifth transistor ST5 is electrically connected to the anode of the organic light emitting diode.

One terminal of the first storage capacitor Cst is electrically connected to the first node N1, and the other terminal of the first storage capacitor Cst is electrically connected to the second node N2.

The first driving transistor DT and the transistors ST1-ST5 may be implemented as P-type MOSFETs.

Figure 2B:
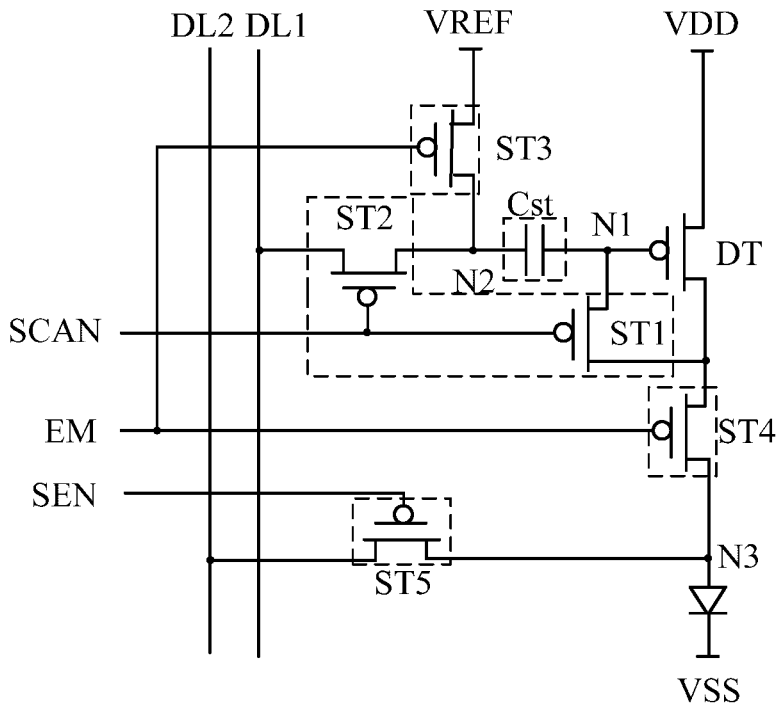
FIG. 2*b* shows a schematic structural diagram of another implementation of a pixel driving circuit on an organic light emitting display panel according to the present application.

In some optional implementations of this embodiment, the data line set DL includes two data lines, which are a first data line DL1 and a second data line DL2 respectively. Specifically, the pixel driving circuit has a structure as shown in FIG. 2*b*. In FIG. 2*b*, the first data write unit 202 includes a first transistor ST1 and a second transistor ST2, the first reset unit 201 includes a third transistor ST3, the first storage unit 203 includes a first storage capacitor Cst, the first light emission control unit 205 includes a fourth transistor ST4, and the first threshold detection unit 206 includes a fifth transistor ST5.

As is different from the pixel driving circuit shown in FIG. 2*a*, in FIG. 2*b*, a first electrode of the second transistor ST2 is electrically connected to the first data line DL1, and a second electrode of the fifth transistor is electrically connected to the second data line DL2. The first data line DL1 provides a data signal to the pixel driving circuit, and the second data line DL2 provides a detection voltage to the pixel driving circuit. Compared with the situation in FIG. 2*a* where the data voltage and the detection voltage are provided by one data line, the power consumption of the pixel driving circuit can be reduced greatly in this manner by disposing the first data line DL1 for providing the data voltage and the second data line DL2 for providing the detection voltage. At the same time, the inter-signal interference caused by the transmission of the data voltage and the detection voltage on the same data line is also avoided, thereby improving the charge and discharge effects of the data line.

Figure 3A:
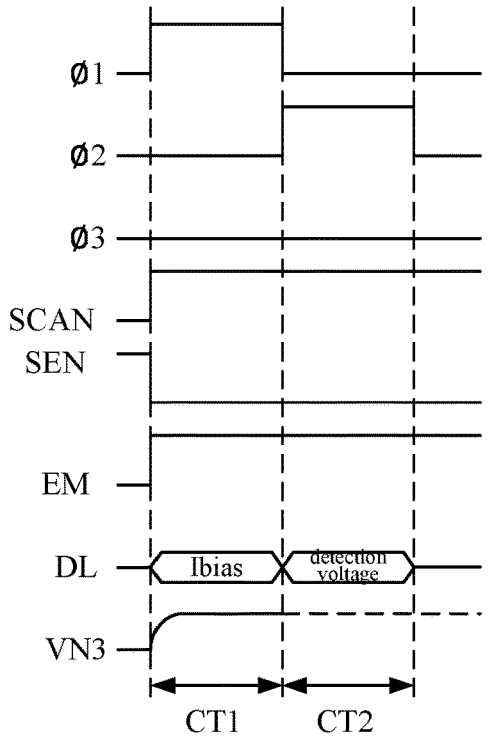
FIG. 3*a* shows a schematic timing diagram in a compensation drive phase of the pixel driving circuit shown in FIG. 2*a;*
Figure 3B:
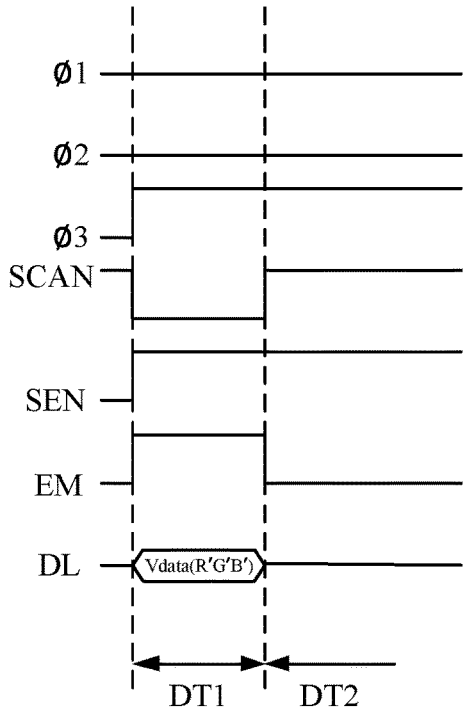
FIG. 3*b* shows a schematic timing diagram in an implementation of the drive phase of the pixel driving circuit shown in FIG. 2*a;*

The work cycle of the pixel driving circuit shown in FIG. 2*a* may include a compensation drive phase and a normal drive phase, in which the compensation drive phase can be divided into a precharge phase and a threshold detection phase, and the normal drive phase can be divided into a data write phase and a light emitting phase. FIG. 3*a* shows a timing diagram in a compensation drive phase of the pixel driving circuit shown in FIG. 2*a*, and FIG. 3*b* shows a timing diagram in a normal drive phase of the pixel driving circuit shown in FIG. 2*a*.

As shown in FIG. 3*a*, the compensation drive phase includes a precharge phase CT1 and a threshold detection phase CT2. The precharge phase CT1 is used for charging the data line DL by using a bias current signal; and the threshold detection phase CT2 is used for sampling an anode voltage of the organic light emitting diode. That is, each bias current corresponds to one anode voltage. Then, a current-voltage-brightness curve of the organic light emitting diode can be obtained by multiple repetitions of the compensation drive phase, and the size of a degraded voltage of the organic light emitting diode at the same bias current can be determined by comparing the obtained current-voltage-brightness curve with an original current-voltage-brightness curve of the organic light emitting diode. Therefore, the degraded voltage can be compensated.

In the precharge phase CT1, both the scan signal provided by the scan line SCAN and the light emission control signal provided by the light emission control signal line EM are at a high level, and the threshold detection signal provided by the threshold detection signal line SEN is at a low level, so ST1-ST4 are turned off, and ST5 is turned on. At the same time, the first switch control signal Ø1 is at a high level, and both the second switch control signal Ø2 and the third switch control signal Ø3 are at a low level, so the first switch array is turned on, and the second switch array and the third switch array are turned off. As a result, the data line DL is rapidly charged by a bias current signal provided from the power module, and transmits the bias current signal to the anode of the organic light emitting diode.

In the threshold detection phase CT2, the scan signal provided by the scan line SCAN and the light emission control signal provided by the light emission control signal line EM are still at a high level, and the threshold detection signal provided by the threshold detection signal line SEN is still at a low level, so ST1-ST4 are still turned off, and ST5 is still turned on. At the same time, the second switch control signal Ø2 is at a high level, and both the first switch control signal Ø1 and the third switch control signal Ø3 are at a low level, so the second switch array is turned on, and the first switch array and the third switch array are turned off. The sampling module 122 communicates via the second switch array with the data line DL, and samples the anode voltage of the organic light emitting diode.

The precharge phase CT1 and the threshold detection phase CT2 are repeated multiple times, and the power module 121 provides a different bias current in a different precharge phase CT1, such that the sampling module 122 can sample degraded voltages of the organic light emitting diode corresponding to different bias currents. Therefore, the current-voltage-brightness curve of a degraded organic light emitting diode can be determined. The data voltage generation module 123 can generate a data signal for compensating the degraded voltage.

As shown in FIG. 3*b*, the normal drive phase includes a data write phase DT1 and a light emitting phase DT2. The data write phase DT1 is used for detecting a threshold voltage of the first driving transistor DT in the pixel driving circuit as shown in FIG. 2*a*, and the light emitting phase DT2 is used for light emitting.

In the data write phase DT1, the scan signal provided by the scan line SCAN is at a low level, and the light emission control signal provided by the light emission control signal line EM and the threshold detection signal provided by the threshold detection signal line SEN are at a high level, so the first transistor ST1 and the second transistor ST2 are turned on, and ST3-ST5 are turned off. At the same time, the third switch control signal Ø3 is at a high level, and the first switch control signal Ø1 and the second switch control signal Ø2 are at a low level, so the third switch array is turned on, and the first switch array and the second switch array are turned off. The data voltage generation module 123 converts modulated digital video data (R'G'B') into a data voltage Vdata, and provides it to the data line DL. It should be understood that in the data voltage Vdata, the degraded voltage of the organic light emitting diode has been compensated. Because ST1 and ST2 are turned on, the voltage of the second node N2 is Vdata. An intermediate compensation value Vdd−Vth·DT is applied to the first node N1 through a short circuit between a gate and a drain of the first driving transistor DT. The intermediate compensation value Vdd−Vth·DT is used for compensating the degradation difference of the first driving transistor DT, and the intermediate compensation value is determined by subtracting the threshold voltage Vth·DT of the first driving transistor DT from the high-potential driving voltage Vdd. The first storage capacitor Cst maintains the potential of the first node N1 that is the intermediate compensation value Vdd−Vth·DT, and maintains the potential of the second node N2 that is the data voltage Vdata.

In the light emitting phase DT2, both the scan signal provided by the scan line SCAN and the threshold detection signal provided by the threshold detection signal line SEN are at a high level, and the light emission control signal provided by the light emission control signal line EM is at a low level, so the third transistor ST3 and the fourth transistor ST4 are turned on, and the first transistor ST1, the second transistor ST2, and the fifth transistor ST5 are turned off. The third switch control signal Ø3 is at a high level, and the first switch control signal Ø1 and the second switch control signal Ø2 is at a low level, so the third switch array is continuously turned on, and the first switch array and the second switch array are still turned off. Because the third transistor ST3 is turned on, the reference voltage Vref provided by the reference signal line is applied onto the second node N2, and the potential of second node N2 changes from the data voltage Vdata into the reference voltage Vref. Because the first storage capacitor is connected between the first node N1 and the second node N2, the potential change Vdata−Vref of the second node N2 is reflected in the potential of the first node N1, so the potential of the first node N1 changes from the intermediate compensation value Vdd−Vth·DT into a final compensation value Vdd−Vth·DT−(Vdata−Vref). The final compensation value Vdd−Vth·DT−(Vdata−Vref) is used for compensating the degradation difference of the first driving transistor DT.

Therefore, the threshold voltage of the first driving transistor DT in the pixel driving circuit shown in FIG. 2*a* is internally compensated, thereby reducing the degradation difference of the first driving transistors DT on the organic light emitting display panel.

Figure 3C:
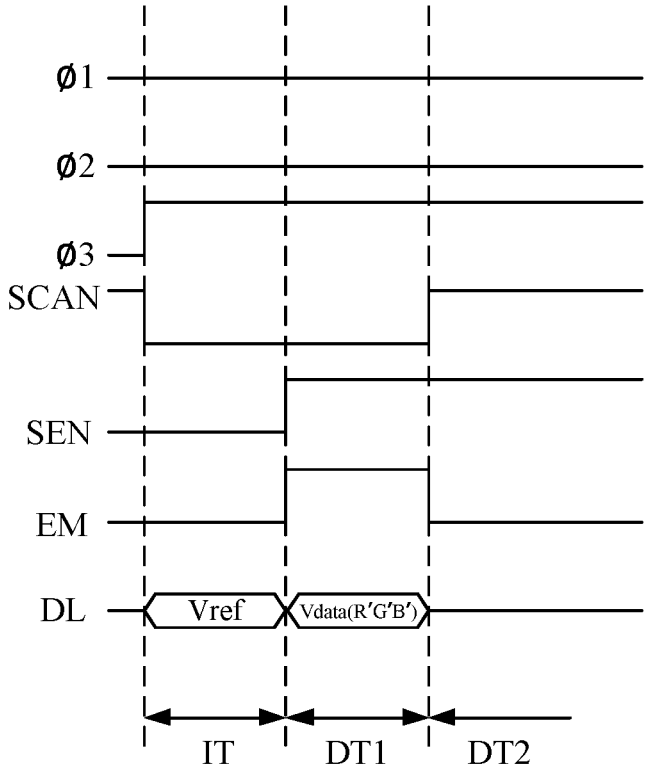
FIG. 3*c* shows a schematic timing diagram in another implementation of the drive phase of the pixel driving circuit shown in FIG. 2*a;*

In some optional implementations of this embodiment, the normal drive phase may further include an initialization phase not shown in FIG. 3*b*, for resetting the first node N1, the second node N2, and a third node N3 before the precharge phase DT1. Specifically, a timing diagram is as shown in FIG. 3*c*. In an initialization phase IT, the scan signal provided by the scan line SCAN, the light emission control signal provided by the light emission control line EM, and the threshold detection signal provided by the threshold detection signal line SEN are all at a low level, so the first transistor ST1 to the fifth transistor ST5 are all turned on. At the same time, the third switch control signal Ø3 is at a high level, and the first switch control signal Ø1 and the second switch control signal Ø2 are at a low level, so the third switch array is turned on, and the first switch array and the second switch array are turned off. The data voltage generation module 123 provides the reference voltage Vref to the data line, and the first node N1, the second node N2, and the third node N3 are initialized to the reference voltage Vref. Because the reference voltage Vref is lower than the threshold voltage of the organic light emitting diode, the organic light emitting diode does not emit light in the initialization phase IT.

The work cycle of the pixel driving circuit shown in FIG. 2*b* is the same as that of the pixel driving circuit shown in FIG. 2*a*, and the corresponding timing is also the same, which are not further described here again.

Figure 4:
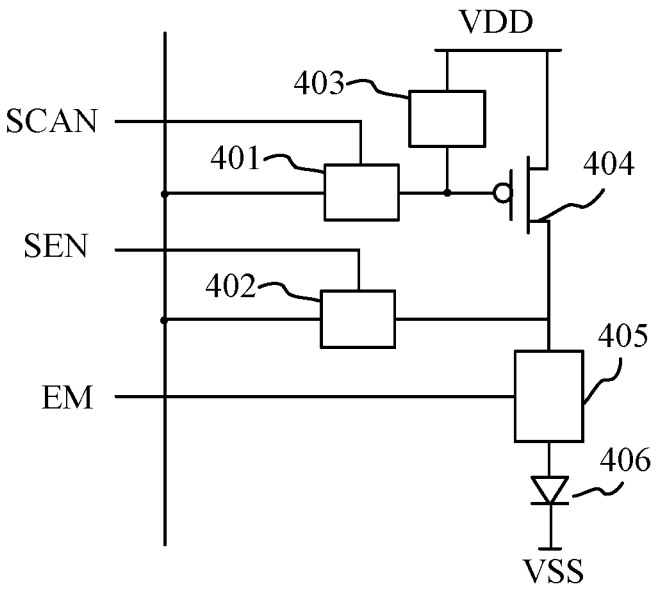
FIG. 4 shows a schematic structural diagram of another embodiment of a pixel driving circuit on an organic light emitting display panel according to the present application.

FIG. 4 shows a schematic structural diagram of another embodiment of a pixel driving circuit on an organic light emitting display panel according to the present application. In this embodiment, the data line set includes one data line. The organic light emitting display panel of this embodiment includes a scan line SCAN, a light emission control signal line EM, and a threshold detection signal line SEN. A pixel driving circuit in this embodiment includes a second data write unit 401, a second threshold compensation unit 402, a second storage unit 403, a second light emission control unit 405, a second driving transistor 404, and an organic light emitting diode 406.

The second data write unit 401 is electrically connected to the data line DL, and transmits a signal from the data line DL to a gate of the second driving transistor 404 based on a signal from the scan line SCAN.

The second storage unit 403 is electrically connected to the gate of the second driving transistor 404 and a third source voltage terminal, and configured to store the signal transmitted to the second driving transistor 404.

The second threshold compensation unit 402 is electrically connected to the data line DL, and transmits the signal from the data line DL to a second electrode of the second driving transistor 404 based on a signal from the threshold detection signal line SEN.

The second light emission control unit 405 is electrically connected to the light emission control signal line EM and configured to control the light emission of the organic light emitting diode 406.

A cathode of the organic light emitting diode 406 is electrically connected to a fourth source voltage terminal.

Figure 4A:
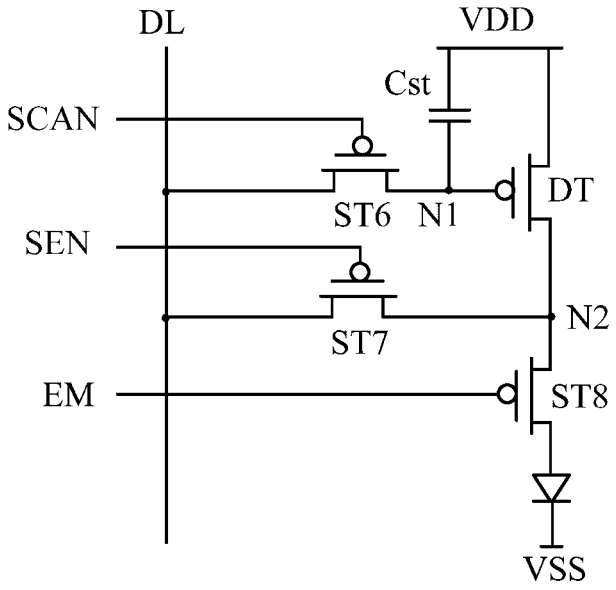
FIG. 4*a* shows a schematic structural diagram of an implementation of a pixel driving circuit on an organic light emitting display panel according to the present application.

FIG. 4*a* shows a specific structure of the pixel driving circuit. As shown in FIG. 4*a*, the second data write unit 401 includes a sixth transistor ST6. A gate of the sixth transistor ST6 is electrically connected to the scan line SCAN, a first electrode of the sixth transistor ST6 is electrically connected to the data line DL, and a second electrode of the sixth transistor ST6 is electrically connected to the gate of the second driving transistor DT.

The second threshold compensation unit 402 includes a seventh transistor ST7. A gate of the seventh transistor ST7 is electrically connected to the threshold detection signal line SEN, a first electrode of the seventh transistor ST7 is electrically connected to the data line DL, and a second electrode of the seventh transistor ST7 is electrically connected to the second electrode of the second driving transistor DT.

The second storage unit 403 includes a second storage capacitor Cst. One terminal of the second storage capacitor Cst is electrically connected to the third source voltage terminal, and the other terminal of the second storage capacitor Cst is electrically connected to the second electrode of the sixth transistor ST6 and the gate of the second driving transistor DT.

The second light emission control unit 405 includes an eighth transistor ST8. A gate of the eighth transistor ST8 is electrically connected to the light emission control signal line EM, a first electrode of the eighth transistor ST8 is electrically connected to the second electrode of the second driving transistor DT, and a second electrode of the eighth transistor ST8 is electrically connected to an anode of the organic light emitting diode.

A cathode of the organic light emitting diode is electrically connected to the fourth source voltage terminal. The third source voltage terminal has a high-potential driving voltage Vdd, and the fourth source voltage terminal has a low-potential driving voltage Vss.

The connection point of the second electrode of the sixth transistor ST6, the gate of the second driving transistor DT, and one terminal of the second storage capacitor Cst is a first node N1, and the connection point of the second electrode of the second driving transistor DT, the second electrode of the seventh transistor ST7, and the first electrode of the eighth transistor ST8 is a second node N2. The second driving transistor DT and the transistors ST6-ST8 may be implemented as P-type MOSFETs.

The work cycle of the pixel driving circuit shown in FIG. 4*a* includes a compensation drive phase and a normal drive phase. The compensation drive phase is used for sampling a degraded voltage of the organic light emitting diode and a threshold voltage of the second driving transistor DT, to obtain a compensated data voltage Sdata for compensating the degradation of the organic light emitting diode and the degradation of the second driving transistor DT. The normal drive phase is used for applying a data voltage Vdata (R'G'B') reflecting modulated digital data R'G'B' of the compensated data voltage Sdata to the pixel driving circuit.

The compensation drive phase may include a rest phase and a threshold detection phase, and the normal drive phase may include a data write phase and a light emitting phase. The threshold detection phase may further include a first detection phase and a second detection phase, in which the first detection phase includes a current transmission sub-phase and a voltage sampling sub-phase, and the second detection phase includes a voltage transmission sub-phase, a floating sub-phase, and a threshold voltage detection sub-phase.

Figure 5A:
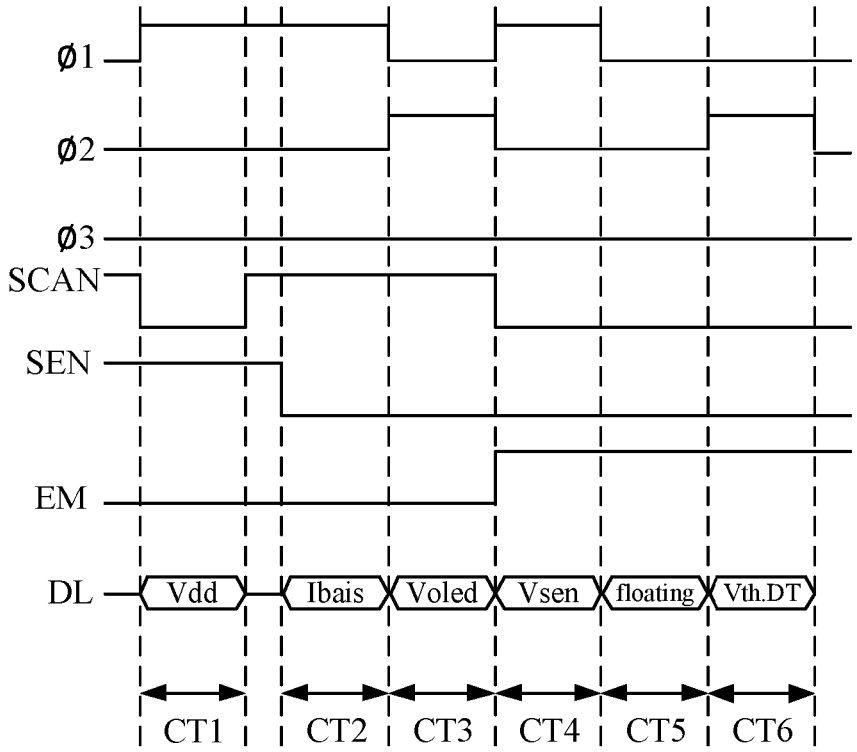
FIG. 5*a* shows a timing diagram in a compensation drive phase of the pixel driving circuit shown in FIG. 4*a;*
Figure 5B:
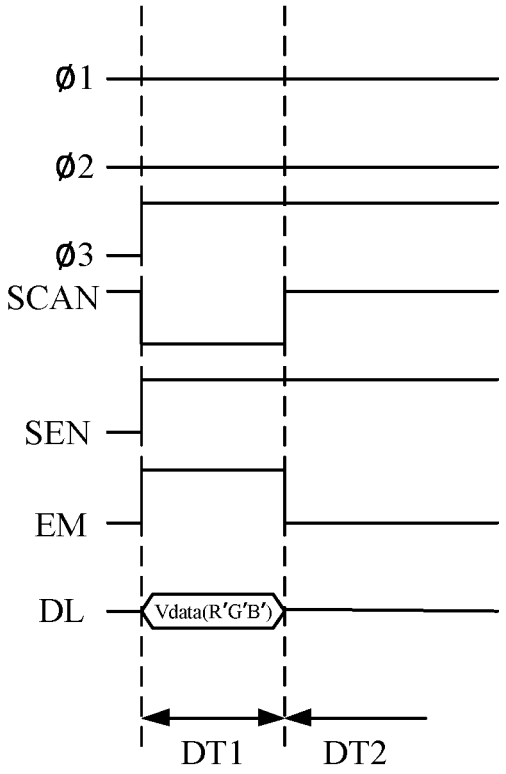
FIG. 5*b* shows a timing diagram in a normal drive phase of the pixel driving circuit shown in FIG. 4*a;*

FIG. 5*a* shows a timing diagram in a compensation drive phase of the pixel driving circuit shown in FIG. 4*a*, and FIG. 5*b* shows a timing diagram in a normal drive phase of the pixel driving circuit shown in FIG. 4*a*. As shown in FIG. 5*a*, the compensation drive phase includes an initialization phase CT1, a current transmission sub-phase CT2, a voltage sampling sub-phase CT3, a voltage transmission sub-phase CT4, a floating sub-phase CT5, and a threshold voltage detection sub-phase CT6. As shown in FIG. 5*b*, the normal drive phase includes a data write phase DT1 and a light emitting phase DT2. The initialization phase CT1 is used for precharging the data line DL and the first node N1 by using the high-potential driving voltage Vdd. The current transmission sub-phase CT2 is used for charging the data line DL and the organic light emitting diode by using a bias current. The voltage sampling sub-phase CT3 is used for sampling an anode voltage of the organic light emitting diode. The voltage transmission sub-phase CT4 is used for primarily charging the data line DL by using a detection voltage Vsen. The floating sub-phase CT5 is used for floating the data line DL and then secondarily charging the data line DL by using a threshold voltage Vth·DT of the second driving transistor DT that is higher than the detection voltage Vsen. The threshold voltage detection sub-phase CT6 is used for sampling the threshold voltage Vth·DT on the data line DL.

The current transmission sub-phase CT2 and the voltage sampling sub-phase CT3 may be implemented repeatedly, to determine a current-voltage-brightness curve of the organic light emitting diode. Therefore, a degraded voltage of the organic light emitting diode at the same current can be determined.

In the initialization phase CT1, both the scan signal provided by the scan line SCAN and the light emission control signal provided by the light emission control signal line EM are at a low level, and the threshold detection signal provided by the threshold detection signal line SEN is at a high level, so ST6 and ST8 are turned on, and ST7 is turned off. At the same time, the first switch control signal Ø1 is at a high level, and both the second switch control signal Ø2 and the third switch control signal Ø3 are at a low level, so the first switch array is turned on, and the second switch array and the third switch array are turned off. The power module 121 provides the high-potential driving voltage Vdd to the data line DL, so as to precharge the data line DL and the first node N1.

In the current transmission sub-phase CT2, the scan signal provided by scan line SCAN is at a high level, and both the threshold detection signal provided by the threshold detection signal line SEN and the light emission control signal provided by the light emission control signal line EM are at a low level, so ST7 and ST8 are turned on, and ST6 is turned off. At the same, the first switch control signal Ø1 is at a high level, and both the second switch control signal Ø2 and the third switch control signal Ø3 are at a low level, so the first switch array is turned on, and the second switch array and the third switch array are turned off. The power module 121 provides a bias current to the data line DL, and the data line DL and the organic light emitting diode are charged by the bias current through the seventh transistor ST7 and the eighth transistor ST8.

In the voltage sampling sub-phase CT3, the scan signal provided by the scan line SCAN is still at a high level, and the threshold detection signal provided by the threshold detection signal line SEN and the light emission control signal provided by the light emission control signal line EM are still at a low level, so ST7 and ST8 are still turned on, and ST6 is still turned off. At the same time, the second switch control signal Ø2 is at a high level, and both the first switch control signal Ø1 and the third switch control signal Ø3 are at a low level, so the second switch array is turned on, and the first switch array and the third switch array are turned off. The sampling module 122 samples the anode voltage of the organic light emitting diode through the data line DL, thereby determining the degradation level of the organic light emitting diode.

In the voltage transmission sub-phase CT4, the scan signal provided by the scan line SCAN and the threshold detection signal provided by the threshold detection signal line SEN are at a low level, and the light emission control signal provided by the light emission control signal line EM is at a high level, so ST6 and ST7 are turned on, and ST8 is turned off. At the same time, the first switch control signal Ø1 is at a high level, and both the second switch control signal Ø2 and the third switch control signal Ø3 are at a low level, so the first switch array is turned on, and the second switch array and the third switch array are turned off. As a result, the data line DL is primarily charged by the detection voltage Vsen from the power module 121. It should be understood that the detection voltage Vsen is lower than the threshold voltage Vth·DT of the second driving transistor DT.

In the floating sub-phase CT5, the scan signal provided by the scan line SCAN and the threshold detection signal provided by the threshold detection signal line SEN are still at a low level, and the light emission control signal provided by the light emission control signal line EM is still at a high level, so ST6 and ST7 are still turned on, and ST8 is still turned off. At the same time, the first switch control signal Ø1, the second switch control signal Ø2 and the third switch control signal Ø3 are all at a low level, so the first switch array, the second switch array, and the third switch array are all turned off. The data line DL is floated, and connected by a short circuit between the gate and a drain of the second driving transistor DT. Because ST6 and ST7 are still turned on, the data line DL is secondarily charged by the third source voltage through the second driving transistor, ST6, and ST7. Then, the voltage difference between the second node N2 and the first node N1 becomes the threshold voltage Vth·DT of the second driving transistor DT. That is to say, the data line DL is secondarily charged to the threshold voltage Vth·DT of the second driving transistor DT.

In the threshold voltage detection sub-phase CT6, the scan signal provided by the scan line SCAN and the threshold detection signal provided by the threshold detection signal line SEN are still at a low level, and the light emission control signal provided by the light emission control signal line EM is still at a high level, so ST6 and ST7 are still turned on, and ST8 is still turned off. At the same time, the second switch control signal Ø2 is at a high level, and both the first switch control signal Ø1 and the third switch control signal Ø3 are at a low level, so the second switch array is turned on, and the first switch array and the third switch array are turned off. The sampling module 122 samples the voltages of the second node N2 and the first node N1 respectively, to obtain the threshold voltage Vth·DT of the second driving transistor DT saved on the data line DL.

In this manner, the degraded voltage of the organic light emitting diode and the threshold voltage Vth·DT of the second driving transistor DT in the pixel driving circuit shown in FIG. 4*a* are both sampled in the compensation drive phase. The data voltage generation module 123 can compensate the organic light emitting diode and the second driving transistor DT based on the degraded voltage and the threshold voltage, thereby achieving the equalization of the brightness of the pixels in the organic light emitting display panel.

As shown in FIG. 5*b*, the normal drive phase of the pixel driving circuit shown in FIG. 4*a* includes a data write phase DT1 and a light emitting phase DT2. The work principle in the normal drive phase of the pixel driving circuit shown in FIG. 4*a* is the same as the work principle in the normal drive phase of the pixel driving circuit shown in FIG. 2*a*. The timing diagram shown in FIG. 5*b* is the same as the timing diagram shown in FIG. 3*b*.

In the data write phase DT1, the scan signal provided by the scan line SCAN is at a low level, and the light emission control signal provided by the light emission control signal line EM and the threshold detection signal provided by the threshold detection signal line SEN are at a high level, so the sixth transistor ST6 is turned on, and the seventh transistor ST7 and the eighth transistor ST8 are turned off. At the same time, the third switch control signal Ø3 is at a high level, and the first switch control signal Ø1 and the second switch control signal Ø2 are at a low level, so the third switch array is turned on, and the first switch array and the second switch array are turned off. The data voltage generation module 123 converts modulated digital video data (R'G'B') into a data voltage Vdata, and provides it to the data line DL. It should be understood that in the data voltage Vdata, the degraded voltage of the organic light emitting diode has been compensated. Because ST6 is turned on, the voltage of first node N1 is Vdata.

In the light emission phase DT2, the scan signal provided by the scan line SCAN and the threshold detection signal provided by the threshold detection signal line SEN are at a high level, and the light emission control signal provided by the light emission control signal line EM is at a low level, so the eighth transistor ST8 is turned on, and the sixth transistor ST6 and the seventh transistor ST7 are turned off. The third switch control signal Ø3 is at a high level, and the first switch control signal Ø1 and the second switch control signal Ø2 are at a low level, so the third switch array is still turned on, and the first switch array and the second switch array are still turned off. Therefore, the potential at the first node N1 is still the data voltage Vdata. At this time, a drive current flowing in the organic light emitting diode is expressed by a formula below:

$$Ioled=k(Vsg-Vth\cdot DT)^2/2=k(Vdd-Vdata-Vth\cdot DT)^2/2.$$

Because in the data voltage Vdata, the threshold voltage Vth·DT of the second driving transistor DT has been compensated, the drive current Ioled flowing in the organic light emitting diode is not affected by the degradation of the second driving transistor DT, thus ensuring that the drive current flowing in the organic light emitting diodes on the organic light emitting display panel is identical, and the brightness of the organic light emitting display panel is uniform.

Figure 6:
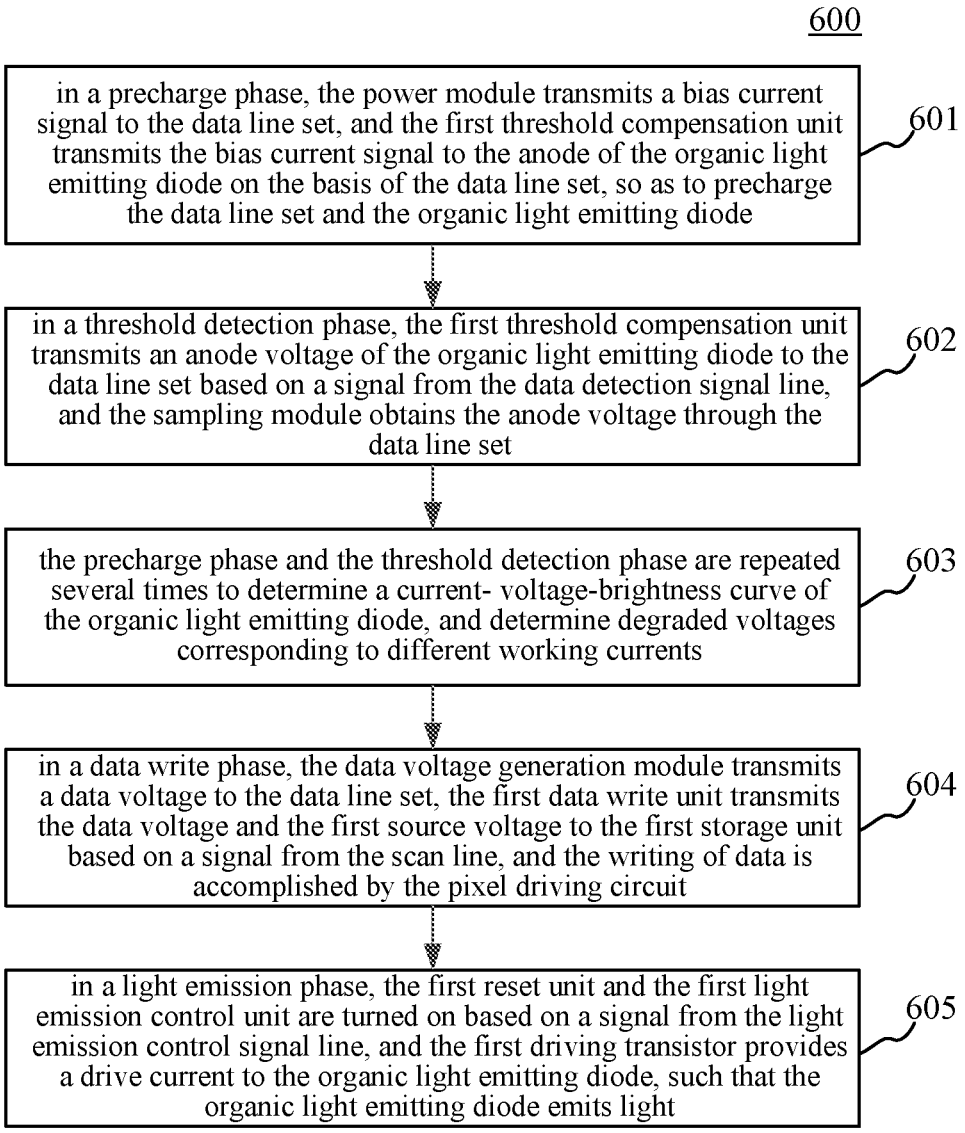
FIG. 6 shows a schematic flow chart of an embodiment of a pixel compensation method according to the present application.

The present application further provides a pixel compensation method for the pixel driving circuit shown in FIG. 2. Specifically, as shown in FIG. 6, the pixel compensation method of this embodiment includes the following steps.

Step 601: in a precharge phase, the power module transmits a bias current signal to the data line set, and the first threshold compensation unit transmits the bias current signal to the anode of the organic light emitting diode on the basis of the data line set, so as to precharge the data line set and the organic light emitting diode.

The first threshold compensation unit may include a fifth transistor, and the threshold detection signal line provides a low level signal. The bias current signal provided by the power module can be transmitted to the anode of the organic light emitting diode via the data line set, thus precharging the data line set and the organic light emitting diode.

It should be understood that, when the data line set includes only one data line, the bias current signal provided by the power module is transmitted via the data line. When the data line set includes two data lines, a first data line is electrically connected to the second transistor, and a second data line is electrically connected to the fifth transistor, so the bias current signal is transmitted via the second data line to the anode of the organic light emitting diode.

Step 602: in a threshold detection phase, the first threshold compensation unit transmits an anode voltage of the organic light emitting diode to the data line set based on a signal from the data detection signal line, and the sampling module obtains the anode voltage through the data line set.

After the bias current signal provided by the power module is transmitted to the organic light emitting diode, the sampling module is in communication with the data line, and the fifth transistor is still turned on, so the sampling module can obtain the anode voltage of the organic light emitting diode via the data line set.

Step 603: the precharge phase and the threshold detection phase are repeated several times to determine a current-voltage-brightness curve of the organic light emitting diode, and determine degraded voltages corresponding to different working currents.

Through Steps 601 and 602, corresponding bias current and anode voltage can be obtained. After Steps 601 and 602 are repeated multiple times, multiple corresponding bias currents and anode voltages can be obtained, thereby determining the current-voltage-brightness curve of the organic light emitting diode. Then, the determined current-voltage-brightness curve is compared with an original current-voltage-brightness curve of the organic light emitting diode, to determine the shift of the threshold voltage of the organic light emitting diode at the same current, whereby the degraded voltage of the organic light emitting diode can be determined.

Step 604: in a data write phase, the data voltage generation module transmits a data voltage to the data line set, the first data write unit transmits the data voltage and the first source voltage to the first storage unit based on a signal from the scan line, and the writing of data is accomplished by the pixel driving circuit.

Because the first storage unit is electrically connected to the first node N1 and the second node N2, the first node N1 is the gate of the first driving transistor, and the second node N2 is a point of electrical connection of the first reset unit to the first data write unit. In the data write phase, the signal provided by the scan line is at a low level, so ST1 and ST2 are turned on. The data voltage is transmitted via the data line set to the second node N2, the first source voltage is transmitted via the first driving transistor and ST1 to the first node N1, and the first storage unit stores the voltages of the first node N1 and the second node N2.

Step 605: in a light emission phase, the first reset unit and the first light emission control unit are turned on based on a signal from the light emission control signal line, and the first driving transistor provides a drive current to the organic light emitting diode, such that the organic light emitting diode emits light.

The first reset unit may include a third transistor, and the first light emission control unit may include a fourth transistor. In the light emission phase, the signal provided by the light emission control signal line is at a low level, and the third transistor and the fourth transistor are turned on. Because the third transistor is electrically connected to the reference signal line, the reference voltage provided by the reference signal line is transmitted to the second node N2, and the voltage of the second node N2 is decreased from the data voltage to the reference voltage. The voltage of the first node N1 is also decreased correspondingly by a difference of the data voltage from the reference voltage. The first driving transistor is turned on, and provides the drive current to the organic light emitting diode, and the organic light emitting diode emits light under the action of the drive current.

Through the pixel compensation method provided in the embodiment of the present application, the degradation difference of the organic light emitting diodes in the pixel driving circuit can be effectively compensated, thereby equalizing the brightness of the organic light emitting display panel.

Figure 7:
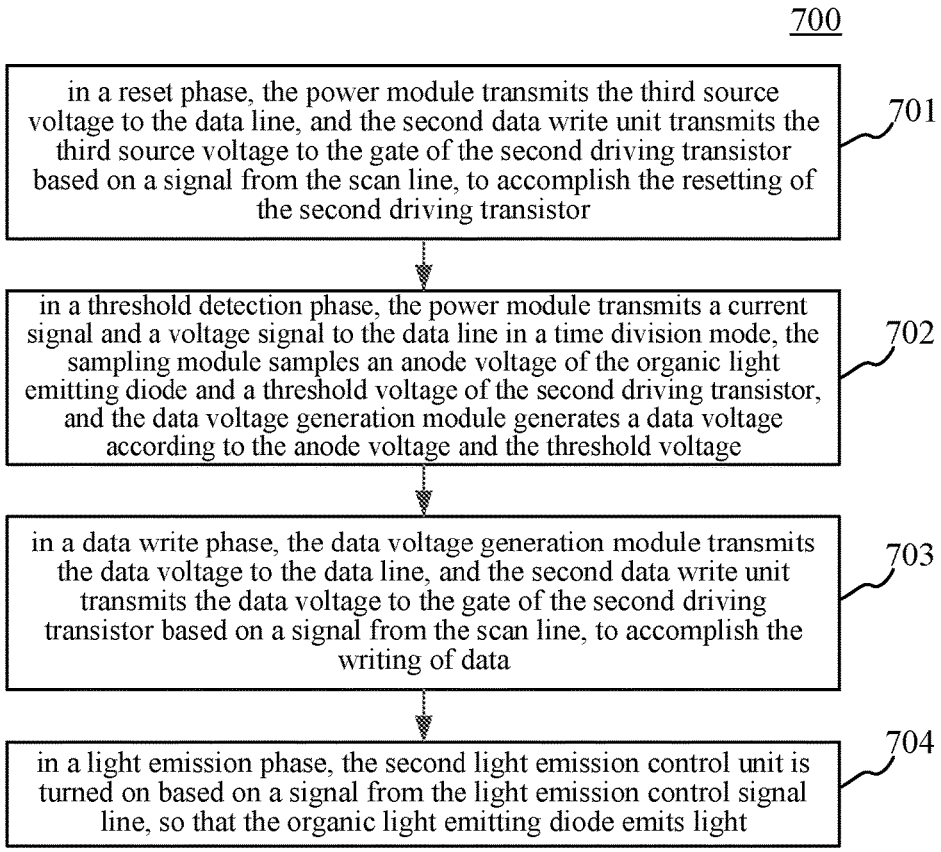
FIG. 7 shows a schematic flow chart of an embodiment of a pixel compensation method according to the present application.

The present application further provides a pixel compensation method for the pixel driving circuit shown in FIG. 4. Specifically, as shown in FIG. 7, the pixel compensation method of this embodiment includes the following steps.

Step 701: in a reset phase, the power module transmits the third source voltage to the data line, and the second data write unit transmits the third source voltage to the gate of the second driving transistor based on a signal from the scan line, to accomplish the resetting of the second driving transistor.

The second data write unit may include a sixth transistor. In the reset phase, the sixth transistor is turned on, the power module transmits the third source voltage to the data line, and the third source voltage is transmitted via the sixth transistor to the gate of the second driving transistor, that is, the first node, thus accomplishing the resetting of the second driving transistor.

Step 702: in a threshold detection phase, the power module transmits a current signal and a voltage signal to the data line in a time division mode, the sampling module samples an anode voltage of the organic light emitting diode and a threshold voltage of the second driving transistor, and the data voltage generation module generates a data voltage according to the anode voltage and the threshold voltage.

In the threshold detection phase, the power module may transmit a current signal to the data line or transmit a voltage signal to the data line. The current signal is used to sample the anode voltage of the organic light emitting diode, and the voltage signal is used to sample the threshold voltage of the second driving transistor. The data voltage generation module generates a data voltage according to the anode voltage of the organic light emitting diode and the threshold voltage of the second driving transistor.

Step 703: in a data write phase, the data voltage generation module transmits the data voltage to the data line, and the second data write unit transmits the data voltage to the gate of the second driving transistor based on a signal from the scan line, to accomplish the writing of data.

In the data write phase, the sixth transistor is turned on, and the data voltage provided by the data voltage generation module can be transmitted to the gate of the second driving transistor, to accomplish the writing of data.

Step 704, in a light emission phase, the second light emission control unit is turned on based on a signal from the light emission control signal line, so that the organic light emitting diode emits light.

The second light emission control unit includes an eighth transistor. In a light emission phase, the eighth transistor is turned on, the second driving transistor is turned on, and a drive current is provided to the organic light emitting diode, so the organic light emitting diode emits light.

In some optional implementations of this embodiment, the threshold detection phase may further include a first detection phase, and the first detection phase includes a current transmission sub-phase and a voltage sampling sub-phase.

In the current transmission sub-phase, the power module transmits a bias current signal to the data line, the second threshold detection unit is turned on based on a signal from the threshold detection signal line, and the second light emission control unit is turned on based on a signal from the light emission control signal line, and transmits the bias current signal to the anode of the organic light emitting diode.

In the voltage sampling sub-phase, the anode voltage of the organic light emitting diode is transmitted to the data line, by the second threshold detection unit based on a signal from the threshold detection signal line and by the second light emission control unit based on a signal from the light emission control signal line, and the sampling module obtains the anode voltage of the organic light emitting diode via the data line.

In some optional implementations of this embodiment, the threshold detection phase may further include a second detection phase, and the second detection phase includes a voltage transmission sub-phase, a floating sub-phase, and a threshold voltage detection sub-phase.

In the voltage transmission sub-phase, the power module transmits a detection voltage to the data line, the second data write unit transmits the detection voltage to the gate of the second driving transistor based on a signal from the scan line, and the second threshold detection unit transmits the detection voltage to the second electrode of the second driving transistor based on a signal from the threshold detection signal line, to accomplish the primary charging of the data line.

In the floating sub-phase, the data line is floated, a short circuit is formed between the gate and the second electrode of the second driving transistor, and the data line is secondarily charged with the third source voltage terminal by the second data write unit based on a signal from the scan line and by the second threshold detection unit based on a signal from the threshold detection line.

In the threshold voltage detection sub-phase, the pixel driving circuit transmits a gate voltage of the second driving transistor based on a signal from the scan line and transmits a drain voltage of the second driving transistor based on a signal from the threshold detection signal line, to the sampling module via the data line, so that the detection on the threshold voltage of the second driving transistor is accomplished by the sampling module.

Through the pixel compensation method provided in the embodiment of the present application, both the degraded voltage of the organic light emitting diode and the threshold voltage of the driving transistor can be compensated, thus ensuring the display brightness of the organic light emitting display panel, further equalizing the brightness of the organic light emitting display panel, and improving the display effect.

Figure 8:
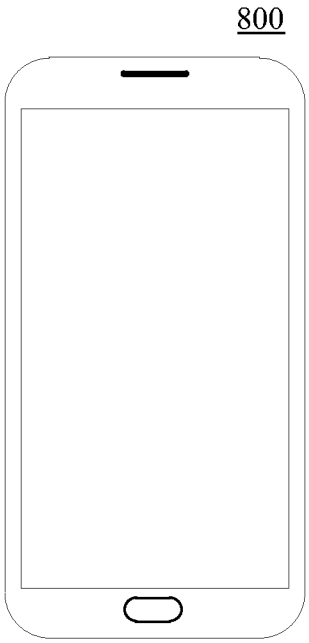
FIG. 8 shows a schematic structural diagram of an embodiment of an organic light emitting display device according to the present application.

As shown in FIG. 8, the present application further provides an organic light emitting display device 800 including an organic light emitting display panel depicted in FIG. 1. Both the degraded voltage of the organic light emitting diode and the threshold voltage of the driving transistor can be compensated by the organic light emitting display device 800 by arranging an external compensation unit and a pixel driving circuit on the organic light emitting display panel, thus ensuring the display brightness of the organic light emitting display panel, further equalizing the brightness of the organic light emitting display panel, and improving the display effect. It should be understood that the organic light emitting display device 800 according to this embodiment may be various electronic devices having a display screen, including, but not limited to, a smart phone, a tablet computer, an e-book reader, an MP3 (Moving Picture Experts Group Audio Layer III) player, an MP4 (Moving Picture Experts Group Audio Layer IV) player, a laptop portable computer, a desktop computer, and so on.

What have been described above are only preferred embodiments of the present application and illustrations of the employed technical principles. Those skilled in the art should understand that the invention scope related to in the present application is not limited to technical solutions formed by specific combinations of the technical features above, which should also cover other technical solutions formed by any arbitrary combination of the technical features above or their equivalent features without departing from the inventive concept. For example, technical features formed by mutual substitution of the features above with technical features with similar functions disclosed in the present application (but not limited thereto).

What is claimed is:

1. An organic light emitting display panel, comprising:

a plurality of data line sets, each comprising at least one data line;

a pixel array, comprising pixel regions configured into M rows and N columns, M and N being positive integers;

a plurality of pixel driving circuits, each configured to be in one of the pixel regions, and electrically connected to the data line sets, wherein each of the pixel driving circuits comprises an organic light emitting diode; and a pixel compensation circuit, configured to provide a bias current to at least one of the pixel driving circuits, sample an anode voltage of the organic light emitting diode of the said at least one of the pixel driving circuits, and generate a compensated data voltage based on the said bias current and the said anode voltage, wherein the pixel compensation circuit comprises a power sub-circuit, a sampling sub-circuit, and a data voltage generation sub-circuit;

wherein the plurality of the data line sets each is electrically connected, via a switch element, to the power sub-circuit, the sampling sub-circuit, and the data voltage generation sub-circuit;

wherein the power sub-circuit is configured to provide the bias current to the data line set, and to transmit the bias current, via one of the plurality of the data line sets, to one of the organic light emitting diodes associated with one of the plurality of pixel driving circuits;

wherein the sampling sub-circuit sampling the anode voltage of the organic light emitting diode via one of the plurality of the data line sets; and wherein the data voltage generation sub-circuit transmits the compensated data voltage, via one of the plurality of the data line sets, to the associated one of plurality of the pixel driving circuits based on the anode voltage and the bias current, wherein at least one of the plurality of pixel driving circuits further comprising: a scan line, a light emission control signal line, a reference signal line, a threshold detection signal line, a first reset unit, a first data write unit, a first storage unit, a first driving transistor, a first light emission control unit, and a first threshold compensation unit;

wherein the first reset unit is electrically connected to the reference signal line, and transmits a signal from the reference signal line to a second node based on a signal from the light emission control signal line;

wherein the second node is a connection point for the first data write unit, the first reset unit, and the first storage unit;

wherein the first data write unit is electrically connected to an associated one of the plurality of data line sets, and transmits a signal from the said data line set to the second node and a first node based on a signal from the scan line, the first node is a connection point for the first data write unit, the first driving transistor, and the first storage unit;

wherein the first storage unit is electrically connected to the first reset unit, the first data write unit, and the first driving transistor, and configured to store a voltage between the first node and the second node;

wherein the first light emission control unit is electrically connected to the light emission control signal line, and configured to control the light emission of the organic light emitting diode;

wherein the first threshold compensation unit is electrically connected to the said data line set, transmits a signal from the said data line set to an anode of the organic light emitting diode based on a signal from the threshold detection signal line, samples the anode voltage of the organic light emitting diode, and transmits the sampled anode voltage to the data line set; and wherein a cathode of the organic light emitting diode is electrically connected to a first source voltage terminal.

2. The organic light emitting display panel according to claim 1, wherein at least one of the plurality of the pixel driving circuit further comprises a driving transistor for driving the organic light emitting diode;

wherein the power sub-circuit is further configured to provide a threshold voltage detection signal to associated one of the plurality of the data line sets, and to transmit the threshold voltage detection signal, via the associated one of the data line sets, to a gate and a drain of the driving transistor; and wherein the sampling sub-circuit obtains a gate voltage and a drain voltage of the driving transistor via the associated one of the data line sets, to determine a threshold voltage of the driving transistor.

3. The organic light emitting display panel according to claim 1, the first data write unit comprises a first transistor and a second transistor, wherein a gate of the first transistor and a gate of the second transistor are electrically connected to the scan line, a first electrode of the first transistor is electrically connected to a gate of the first driving transistor, a second electrode of the first transistor is electrically connected to a second electrode of the first driving transistor, a first electrode of the second transistor is electrically connected to the data line, and a second electrode of the second transistor is electrically connected to the first reset unit.

4. The organic light emitting display panel according to claim 1, wherein said data line set comprises a first data line and a second data line, and the first data write unit comprises a first transistor and a second transistor, wherein a gate of the first transistor and a gate of the second transistor are electrically connected to the scan line, a first electrode of the first transistor is electrically connected to a gate of the first driving transistor, a second electrode of the first transistor is electrically connected to a drain of the first driving transistor, a first electrode of the second transistor is electrically connected to the first data line, and a second electrode of the second transistor is electrically connected to the first reset unit.

5. The organic light emitting display panel according to claim 3, wherein the first reset unit comprises a third transistor, wherein a gate of the third transistor is electrically connected to the light emission control signal line, wherein a first electrode of the third transistor is electrically connected to the reference signal line, and wherein a second electrode of the third transistor is electrically connected to the second electrode of the second transistor.

6. The organic light emitting display panel according to claim 1, wherein the first light emission control unit comprises a fourth transistor, wherein a gate of the fourth transistor is electrically connected to the light emission control signal line, wherein a first electrode of the fourth transistor is electrically connected to the second electrode of the first driving transistor, and wherein a second electrode of the fourth transistor is electrically connected to the anode of the organic light emitting diode.

7. The organic light emitting display panel according to claim 6, wherein the first threshold compensation unit comprises a fifth transistor, wherein a gate of the fifth transistor is electrically connected to the threshold detection signal line, wherein a first electrode of the fifth transistor is electrically connected to the data line, and wherein a second electrode of the fifth transistor is electrically connected to the anode of the organic light emitting diode.

8. The organic light emitting display panel according to claim 6, wherein the data line set comprises a first data line and a second data line; and wherein the threshold compensation unit comprises a fifth transistor, wherein a gate of the fifth transistor is electrically connected to the threshold detection line, wherein a first electrode of the fifth transistor is electrically connected to the second data line, and wherein a second electrode of the fifth transistor is electrically connected to the anode of the organic light emitting diode.

9. The organic light emitting display panel according to claim 3, wherein the first storage unit comprises a first storage capacitor, wherein a terminal of the first storage capacitor is electrically connected to the gate of the first driving transistor, and wherein another terminal of the first storage capacitor is electrically connected to the second electrode of the second transistor.

10. A pixel compensation method for operating an organic light emitting display panel according to claim 1, comprising:

in a precharge phase, transmitting a bias current signal from the power sub-circuit to the data line set; and transmitting the bias current signal from the first threshold compensation unit to the anode of the organic light emitting diode on the basis of the said one of the plurality of the data line sets, to precharge the said data line set and the organic light emitting diode;

in a threshold detection phase, transmitting an anode voltage of the organic light emitting diode from the first threshold compensation unit to the said data line set based on a signal from the threshold detection signal line; and obtaining the anode voltage via the said data line set by the sampling sub-circuit;

repeating the precharge phase and the threshold detection phase, to determine a current-voltage-brightness curve of the organic light emitting diode, and to determine degraded voltages corresponding to different working currents;

in a data write phase, transmitting a data voltage from the data voltage generation sub-circuit to the data line set;

transmitting the data voltage and the first source voltage from the first data write unit to the first storage unit based on a signal from the scan line; and completing the writing of data by the pixel driving circuit; and in a light emission phase, turning on the first reset unit and the first light emission control unit based on a signal from the light emission control signal line;

providing a drive current to the organic light emitting diode by the first driving transistor; and light emitting by the organic light emitting diode.

11. An organic light emitting display device, comprising an organic light emitting display panel according to claim 1.

* * * * *